US005374156A

United States Patent [19]

Simpson et al.

[11] Patent Number: 5,374,156

[45] Date of Patent: Dec. 20, 1994

[54] CARRIAGE ASSEMBLY AND SIDE SHIFT SYSTEM FOR A LIFT TRUCK

[75] Inventors: Clark C. Simpson, Lexington, Ky.; Jeffrey C. Hansell, Ames, Iowa; Jack L. Shafe, Paris, Ky.

[73] Assignee: Clark Material Handling Company, Lexington, Ky.

[21] Appl. No.: 270,529

[22] Filed: Jul. 5, 1994

Related U.S. Application Data

[60] Continuation of Ser. No. 981,679, Nov. 25, 1992, abandoned, which is a division of Ser. No. 587,042, Sep. 24, 1990, Pat. No. 5,326,217.

[51] Int. Cl.[5] ..... B66B 9/20

[52] U.S. Cl. ..... 414/667; 414/671; 414/785; 414/638; 414/635; 414/673; 405/3; 187/226

[58] Field of Search ..... 414/785, 592, 630, 637, 414/641, 642, 663, 662, 664, 667, 671, 638, 636, 672, 635, 673; 187/9 R, 9 E; 405/1, 3

[56] References Cited

U.S. PATENT DOCUMENTS

| | | | |
|---|---|---|---|
| 2,817,792 | 12/1957 | Chew | 414/785 X |
| 3,223,267 | 12/1965 | Stammen | 414/671 |
| 3,342,361 | 9/1967 | Melin | 414/667 |
| 3,484,851 | 12/1969 | Houseman et al. | 414/667 |
| 3,841,442 | 10/1974 | Erickson et al. | 187/9 E X |
| 4,261,438 | 4/1981 | Olson | 414/631 X |
| 4,506,764 | 3/1985 | Griesenbrock et al. | 414/631 |
| 4,523,886 | 6/1985 | Reeves | 414/667 X |
| 4,797,055 | 1/1989 | Tworoger et al. | 414/283 |
| 4,949,816 | 8/1990 | Brown et al. | 414/631 X |
| 4,987,976 | 1/1991 | Daugherty | 414/785 X |

FOREIGN PATENT DOCUMENTS

| | | | |
|---|---|---|---|
| 3214934 | 10/1983 | Germany | 414/785 |
| 3515524 | 11/1986 | Germany | 414/667 |
| 2016409 | 9/1979 | United Kingdom | 414/631 |
| 204241 | 12/1967 | U.S.S.R. | 414/667 |

*Primary Examiner*—Frank E. Werner

[57] ABSTRACT

A carriage assembly, 20h for a lift truck upright assembly, 12, has pivotally mounted forks, 30, controlled by hydraulic cylinders, 36, that are operated by side shifter circuit, 110, having a single operator control, 124, for manipulating the forks in unison, opening or closing the forks, or shifting them right or left in a coordinated fashion.

11 Claims, 7 Drawing Sheets

CARRIAGE ASSEMBLY AND SIDE SHIFT SYSTEM FOR A LIFT TRUCK

This is a continuation of Ser. No. 07/981,679 filed Nov. 25, 1992, now abandoned which is a division of application Ser. No. 07/587,042 filed Sep. 24, 1990, now U.S. Pat. No. 5,326,217.

TECHNICAL FIELD

The present invention relates generally to the industrial vehicle field and more particularly, to a lift truck providing both extensive positive (upward above ground level) and negative (downward below ground level) lift capabilities such as required of, for example, "marina" type lifts.

BACKGROUND OF THE INVENTION

Certain applications of lift trucks require an upright construction that is capable of providing both positive and negative lift from a ground or support level position. For example, such a lift truck is particularly useful for handling boats in and around marinas. The market for such a lift truck has significantly increased in recent years with ever more and more people owning and operating pleasure boats.

In the marina setting, lift trucks may be utilized to both lower boats into and raise boat out of the water from an elevated dock or the like. Similarly, such lift trucks may be utilized to raise boats for positioning well above the ground in an overhead storage rack.

Heretofore, lift truck designs have been developed for this purpose. One such representative design is disclosed in U.S. Pat. No. 3,841,442 to Erickson et al assigned to the Assignee of the present invention. The lift truck disclosed in the Erickson et al patent includes outer, intermediate and inner, telescoping mast sections with a load carriage elevatable on the inner mast section. The lift truck also includes a pair of actuator cylinders and cooperating chains. These cylinders and chains are connected to the mast sections so that one cylinder and chain set is adapted to elevate the load carriage and the inner mast section above ground level. The other cylinder and chain set is adapted to lower below ground level the load carriage and inner and intermediate mast sections together as a unit in the outer mast section.

Additionally, state-of-the-art marina lift trucks commonly utilize complicated fork structures and controls. Unfortunately, the fork structures typically require maintenance at relatively short intervals to insure reliable operation. Such maintenance is particularly required at ocean marinas due to the corrosive properties of saltwater environments. Additionally, the complicated controls require the individual to receive extensive training before the lift truck can be effectively operated. Even when fully familiar with the operation of the controls, the manipulation of multiple levers as now required on state of the art lift trucks requires additional time thereby reducing the productivity of even a skillful operator.

Another problem typical of prior art lift truck designs relates to the need for an improved fork. Forks presently in use are typically constructed of steel for strength and include a protective cover on the upper surface to cushion and protect a boat hull from direct contact with the steel fork. It has been found, however, that such covers when pinched between the boat hull and the steel fork wear quickly and must be replaced after only a relatively short service life. Additionally, as the covers become worn they have a tendency to retain more and more water when manipulated to lift a boat from the water. Subsequently, when the boat is then positioned in an upper berth of a rack, the water retained in the covers drips down onto underlying boats. This water often includes contaminants such as rust from the forks and grease or oil from the dock side water. These contaminants may stain the finish and/or furnishings of underlying boats to the dissatisfaction of the boat owners. As a result, customer relations of the marina operator may be adversely affected.

From reviewing the above it is clear that a need exists for an improved lift truck providing positive and negative lift capabilities that is particularly adapted for operation in both coastal and inland marinas.

SUMMARY OF THE INVENTION

A primary object of the present invention is to provide a carriage assembly including pivotally mounted forks with relatively widely spaced pivot points. The forks also include an inside strut arrangement that cooperates with the wide pivot points to significantly enhance the durability of the design.

An additional object of the invention is to provide forks with a unique composite construction that are both light weight and durable. The forks include a curved upper surface member that reduces stress concentrations and spreads the load over a larger area of the load being handled. The forks also include jackets of rubber that are specially contoured to fit tightly and cushion the load on the forks.

Still another object of the invention is to provide a hydraulic sideshifter circuit for a lift truck of relatively simple design fully responsive to a single operator control. Advantageously, the sideshifter circuit operates to fully coordinate the movement of both forks and prevent any possibility of passing a fork under the load.

Additional objects, advantages, and other novel features of the invention will be set forth in part in the description that follows and in part will become apparent to those skilled in the art upon examination of the following or may be learned with the practice of the invention. The objects and advantages of the invention may be realized and obtained by means of the instrumentalities and the combinations particularly pointed out in the appended claims.

To achieve the foregoing and other objects, and in accordance with the purposes of the present invention as described herein, an improved lift truck is provided for transporting, lifting and lowering a load. The lift truck includes an upright assembly formed from first, second and third telescoping mast sections. A carriage assembly is mounted for movement along a path on the upright assembly and more particularly the third mast section. The carriage assembly includes forks for engaging and supporting the load.

The lift truck also includes a drive assembly for both the upright assembly and carriage assembly. The drive assembly includes a combination of twinned telescoping, compound hydraulic cylinders and two sets of dead chains that serve to move the carriage assembly at a first relatively slow speed over the first portion of the movement path and at a second, relatively fast speed over the second portion of the movement path. The drive assembly is described in greater detail below.

In accordance with the present invention the carriage assembly includes a frame formed from a pair of transversely spaced, vertically extending lift brackets and a pair of vertically spaced horizontally extending upper and lower fork bars. Three pairs of rollers are mounted to the lift brackets with three rollers on each bracket engaging the opposing inner channels of the I-beam rails forming the third mast section. Forks for supporting a load are pivotally mounted to the frame at the upper fork bars by means of pivot pins. Additionally, a pair of actuators are provided for driving the forks about the pivotal mounting to any selected position. Each fork also includes an inwardly depending strut that has a rearwardly directed surface for bearing against the lower fork bar in any assumable fork position. Advantageously, these struts serve to rigidify the forks and substantially eliminate application of right angle forces to the pivotal mounting thereby significantly increasing both overall service life and intervals between maintenance.

Each of the forks is of composite construction including a box beam foundation and curved upper surface support member. A jacket of rubber material, preferably reinforced with polyester cord is received over and around each fork. The jacket may be held in position on the fork by means of a band clamp adjacent the fork heel. Additionally, a skid plate is mounted beneath the heel of the forks to protect both the forks and particularly the covering jackets from damage through engagement with the ground.

In accordance with yet another aspect of the present invention, a unique sideshifter circuit is provided for selectively shifting the forks of a lift truck to the left or right. The sideshifter circuit includes a single operator control that is connected to a directional control valve. Pressurized fluid is fed from the directional control valve through a valve housing operatively positioned in the feed line between the directional control valve and the fork actuators. The valve housing includes four piloted check valves and one shuttle check valve. Additionally, the valve housing includes two ports connected to the directional control valve with the shuttle valve connected across those ports. Lines are also provided for feeding fluid from the shuttle check valve to the piloted check valves. This fluid acts as a pilot signal to open those check valves.

The valve housing also includes two actuator ports and two diverter ports with one piloted check valve controlling fluid flow through each of the actuator ports and diverter ports. One actuator port is connected to the rod end of one fork actuator with the other actuator port connected to the rod end of the other fork actuator. Similarly, one diverter port is connected to the base end of one fork actuator and the other diverter port is connected to the base end of the other fork actuator.

Advantageously, the sideshifter circuit operates to shift the forks in a coordinated manner in the same direction and at the same speed. Thus, by the convenient manipulation of a single operator control the forks may be shifted to either the left or right as desired to align the forks with the load being picked up or to align the load for positioning in, for example, an overhead berth. The coordinated movement between the forks serves to minimize rocking of the load during shifting. Additionally, the movement insures that one fork is not passed under the load.

In prior art designs this has been a prevalent problem. As a fork is passed under the load, the load becomes unstable. It should be appreciated that the sideshifter circuit serves to automatically stop movement of both forks when one of the forks reaches its limit of travel. This also prevents the inadvertent passing of one fork under the load under circumstances where this problem could not have been prevented in prior art designs.

Still other objects of the invention will become readily apparent to those skilled in this art from the following description wherein there is shown and described a preferred embodiment of this invention simply by way of illustration of one of the modes best suited to carry out the invention. As it will be realized, the invention is capable of other different embodiments and its several details are capable of modifications in various, obvious aspects all without departing from the invention. Accordingly, the drawing and descriptions will be regarded as illustrative in nature and not as restrictive.

BRIEF DESCRIPTION OF THE DRAWING

The accompanying drawing incorporated in and forming a part of the specification, illustrates several aspects of the present invention, and together with the description serves to explain the principles of the invention. In the drawing.

Reference is now made in detail to the preferred embodiment of the invention, an example of which is illustrated in the accompanying drawings.

DETAILED DESCRIPTION OF THE INVENTION

Figure 1:
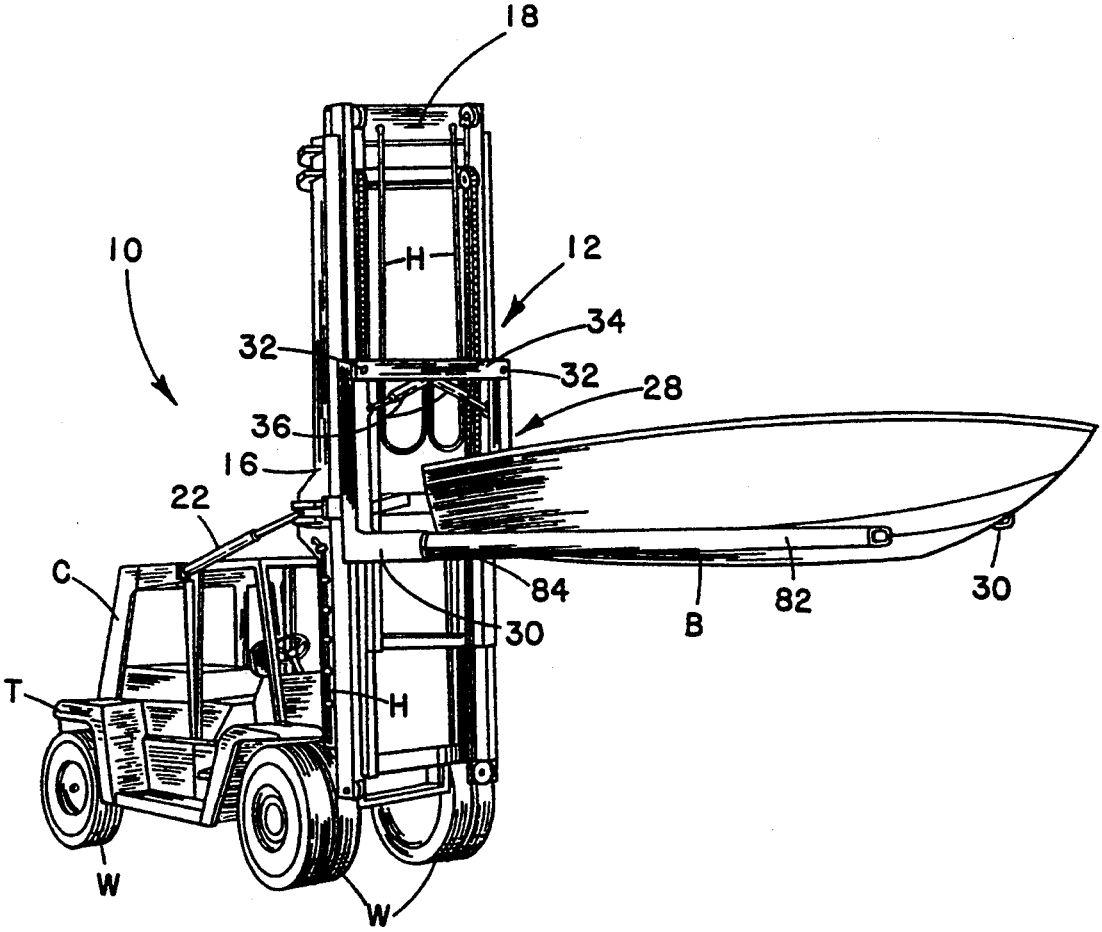
FIG. 1 is a perspective view of a lift truck of the present invention shown holding a boat in a carrying position wherein the operator has a clear view between the side rails of the upright assembly and beneath the bottom of the boat hull.
Figure 2:
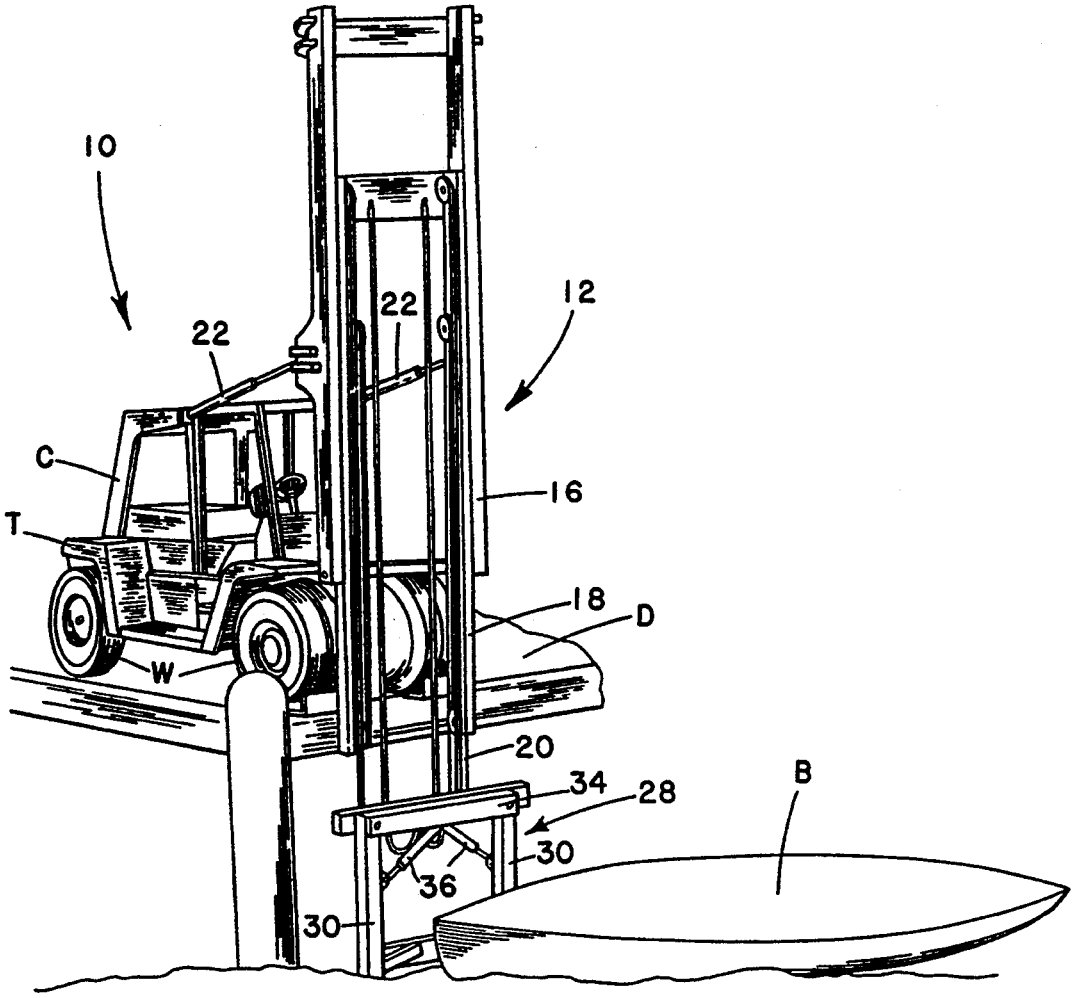
FIG. 2 is a perspective view of the lift truck wherein the upright is shown in a negative lift configuration engaging a boat at dockside.

Referring now to the drawing figures and particularly FIGS. 1 and 2, the apparatus 10 of the present invention is shown. As described in greater detail below, the apparatus 10 provides both extensive positive (upward above ground level as shown in FIG. 1) and negative (downward below ground level as shown in FIG. 2) lift capabilities. Such capability is particularly suited for "marina" type lifts where it is necessary to lower boats into and raise boats out of the water from an elevated dock D. It should be appreciated, however, that the apparatus 10 of the present invention is adapted for uses other than those associated with a marina, that the marina setting is only being utilized as an example and that the broader aspects of the invention should not be limited thereto.

As shown, the apparatus 10 includes an upright assembly 12. The upright assembly 12 is pivotally mounted to a truck T by means of pins 13 received in cooperating dual mounting brackets 14 mounted to the mast section 16 and a pair of mounting yokes Y on the truck frame. Thus, the upright assembly 12 is pivotally mounted in front of and adjacent the top of the front wheels W (see particularly FIG. 5) of the truck T. This mounting serves to move the upright assembly 12 and the load carried thereby back toward the front axle F and center axis of the truck T. As a consequence, a smaller counterweight may be utilized. Additionally, less of a moment arm is required for the counterweight and consequently the overall length of the truck T may be shortened. This advantageously serves to increase the overall maneuverability of the apparatus 10 and even allows closer spacing between boat berthing racks in a storage facility.

As described in greater detail below in the section entitled "Combined Upright and Carriage Assembly", the upright assembly 12 includes first, second and third telescoping mast sections 16, 18, 20 respectively (see also FIGS. 3 and 7). These mast sections 16, 18, 20 are nested in overlapping relation to each other. Fore and aft tilting movement of the upright assembly 12 including the mast section 16, 18, 20 is controlled by a pair of tilt cylinders 22 (one of which is shown) which are connected to opposite sides of the mast section 16 in a manner known in the art. The truck T is also of a type known in the art including an operator cab C. The cab C is mounted on a frame/chassis supported by ground engaging wheels W. The truck T is powered by a motor (not shown) such as a turbocharged diesel engine.

A carriage assembly 28 is mounted for movement along a path on the mast section 20. As described in greater detail below in the section entitled "Combined Upright and Carriage Assembly" the carriage assembly 28 includes a pair of forks 30 pivotally mounted by means of pins 32 to an upper fork bar 34. The gap or distance between the forks 30 is controlled by a pair of actuators 36. By varying the space or gap, the forks 30 may be utilized to engage the hull of a boat B so that the boat may be lifted, transported and lowered as desired using the apparatus 10.

As described in greater detail below, the individual mast sections 16, 18, 20 of the upright assembly 12 and the carriage assembly 28 are driven in a unique manner to provide positive and negative lift configurations utilizing a single drive cylinder. Preferably, the cylinder is twinned and mounted to the apparatus 10 so as to be nested directly behind the mast sections 16, 18 (see FIG. 3). Advantageously, in this way a substantially unobstructed view is provided between the outer rails of the mast sections 16, 18, 20. Hydraulic hoses H that feed the fork actuators 36 are routed within the upright assembly 12 to further improved visibility. Additionally, as described in greater detail below, the need for hose reels extending laterally outside the upright assembly 12 as provided for in prior art designs is eliminated. The resulting increased visibility allows the operator to more effectively guide the apparatus 10 and more accurately and better position the boat B on the forks 30 so as to allow placement in a rack berth. Further, by eliminating the hose reels and moving the hoses H within the upright assembly 12 where they are protected, the problem of snagging hoses on objects common to prior art designs is avoided.

Figure 3:
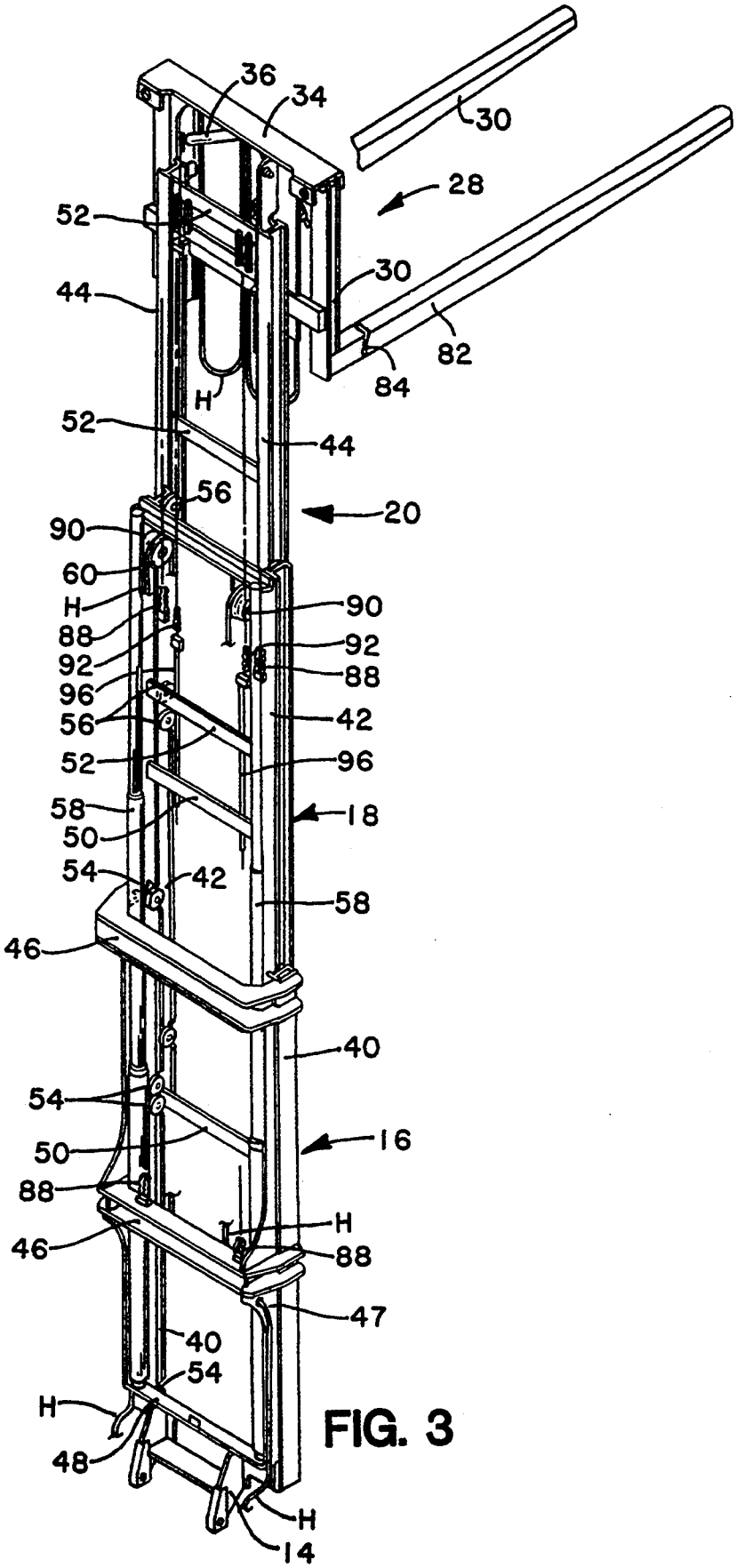
FIG. 3 is a rear quarter perspective view of the combined upright and carriage assembly of the present invention particularly showing the drive assembly.
Figure 3A:
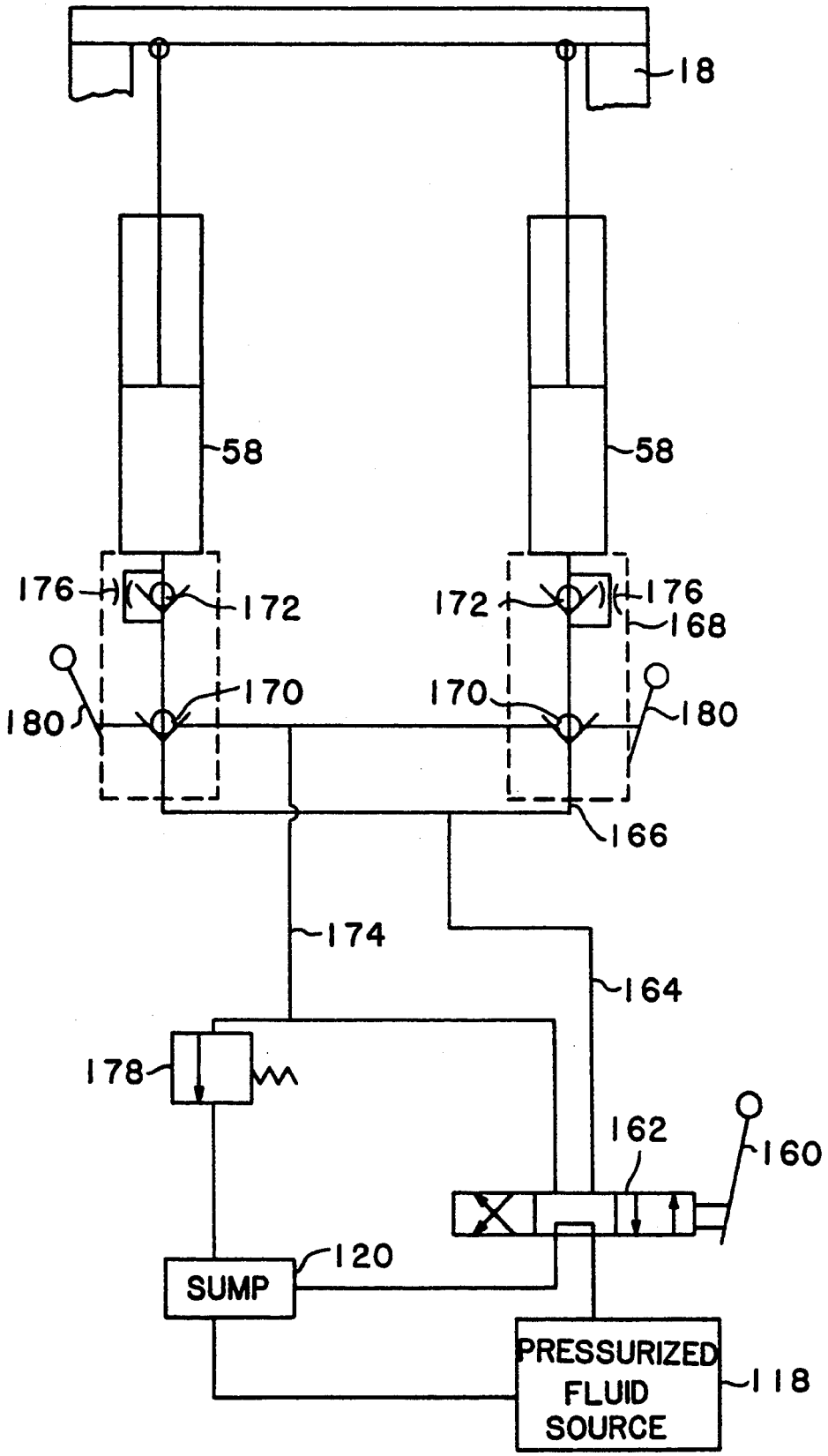
FIG. 3A is a schematical circuit diagram showing one circuit for controlling the operation of the main lift cylinders.
Figure 4:
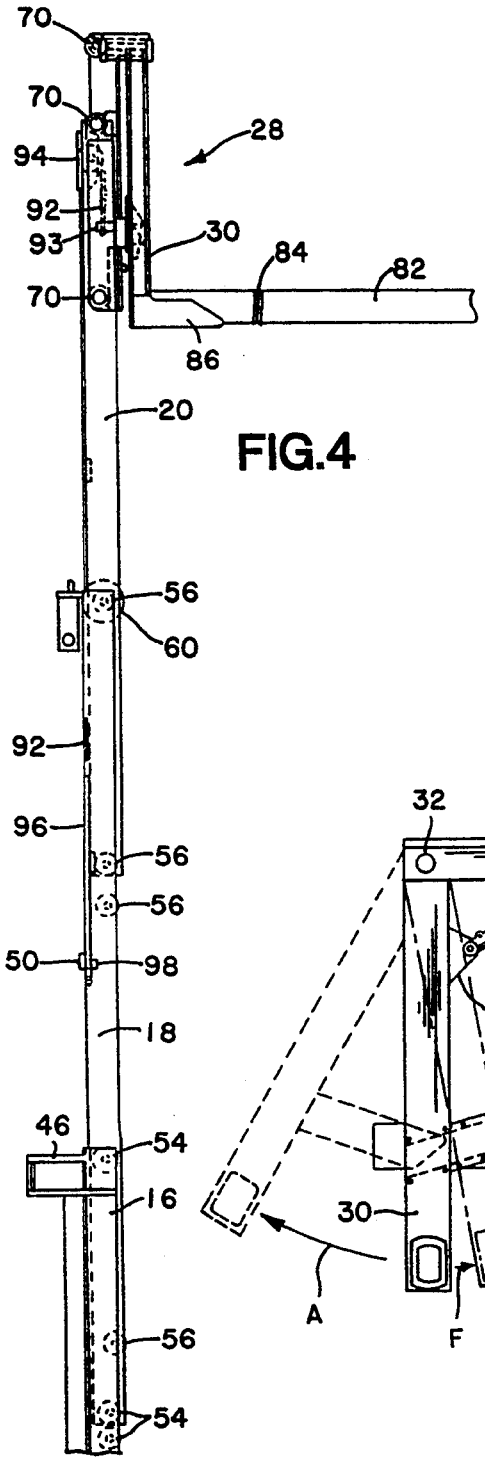
FIG. 4 is a side elevational view showing the combined upright and carriage assembly in a full positive lift configuration.

One possible circuit for controlling the operation of the cylinders 58 is shown in FIG. 3A. As shown, a single lift control lever 160 is operatively connected to a directional control valve 162 for selectively connecting a pressurized fluid source 118 and sump 120 to the cylinders 58.

When the lever 160 is moved in a first direction, pressurized fluid is directed from the source 118 through the directional control valve 162 and the feed line 164 to the port 166 of the locking valve 168 at the base of each cylinder 58. From there, the fluid passes through the check valves 170 and 172 into the base of the cylinders 58 causing the cylinders to expand and raise the intermediate mast section 18 relative to the mast section 16. Simultaneously, fluid pressure is released from the pilot feed line 174 with fluid in the feed line 174 returning to the sump 120.

When the lever 160 is moved in the opposite direction, pressurized fluid is directed from the source 118 through the directional control valve 162 into the pilot feed line 174. The resulting fluid pressure in the line 174 pilots the check valves 170 open. As a result, pressurized fluid is released from the cylinders 58 which then retract, lowering the intermediate mast section 18 relative to the mast section 16. More specifically, the fluid from the cylinders 58 bypasses the check valves 172 by flowing through the restrictor valves 176 which control the flow rate and, therefore, the rate of descent. The fluid passing through the restrictor valves 176 then passes through the check valves 170 held open by the pressurized fluid from the pilot feed line 174. Next, the fluid returns to the sump 120. A pressure relief valve 178 limits the pressure in the pilot feed line 174. As should be appreciated, unless a pilot signal is provided through the feed line 174 or the check valves 170 are manually opened through operation of the actuators 180, any lowering of the mast section 18 relative to the mast section 16 is prevented as flow of fluid from the cylinders 58 is blocked.

Carriage Assembly

Figure 6:
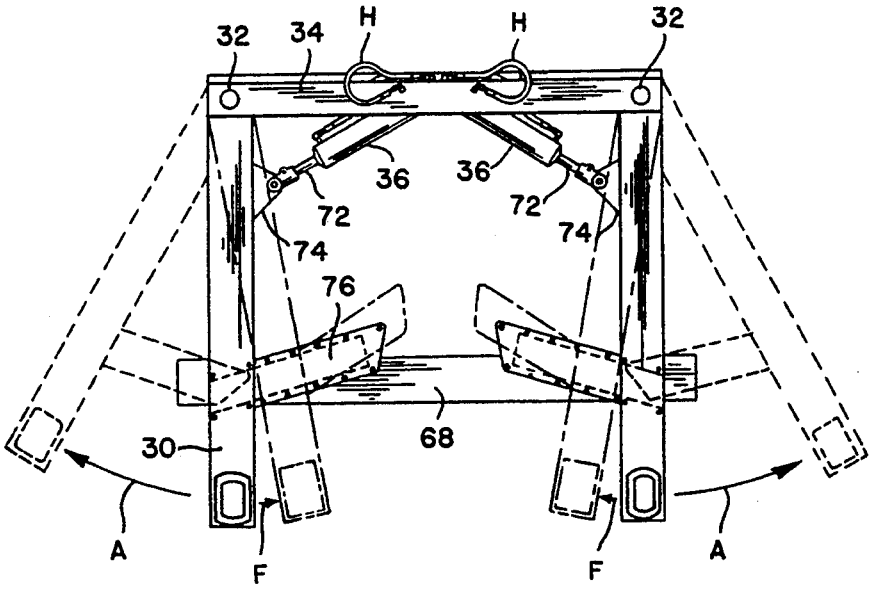
FIG. 6 is view similar to FIG. 5 but showing the carriage assembly alone and demonstrating the relative pivotal movement of the forks.
Figure 5:
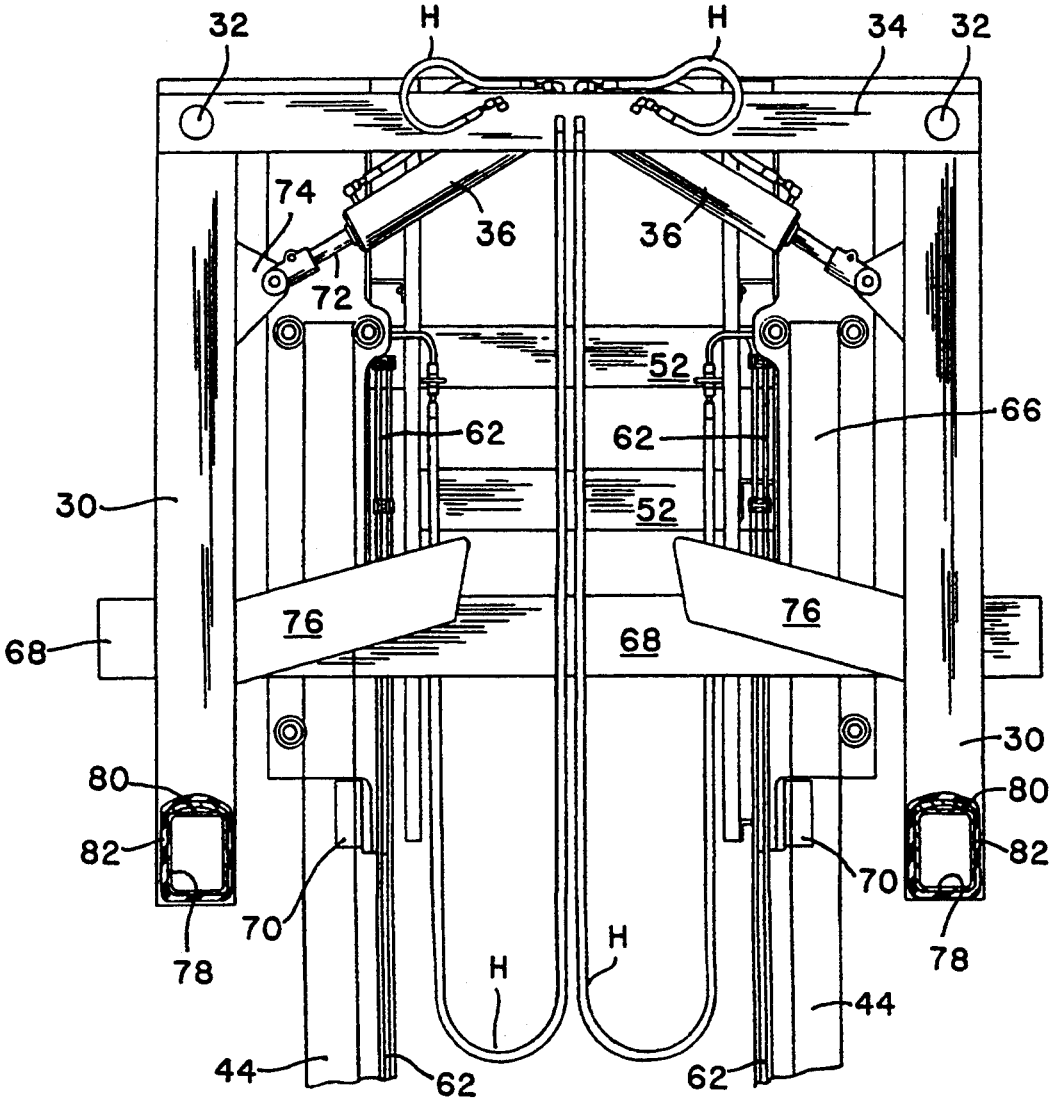
FIG. 5 is a fragmentary and partially sectional front elevational view showing the carriage assembly in a full positive lift configuration including the hydraulic hoses feeding the fork actuators.

As indicated above, the carriage assembly 28 is mounted for relative movement along a path on the inner mast section 20. As best shown in FIGS. 5 and 6 the carriage assembly 28 includes a frame comprising a pair of transversely spaced vertically extending lift brackets 66 and horizontally extending upper and lower fork bars 34 and 68 respectively. The lift brackets 66 and upper and lower fork bars 34, 68 are preferably formed from steel and secured together as by welding to form a rigid frame.

A series of rollers 70 are stub shaft mounted to the lift brackets 66. Preferably, three pairs of rollers 70 are utilized with three rollers mounted to each lift bracket 66. The rollers 70 are adapted to mesh in the inner channels of the I-beam rails 44 of the inner mast section 20. The rollers 70 serve to support the carriage assembly 28 for relative movement within the inner channel portions by riding along the forward and rearward flanges of the I-beam rails 44.

The forks 30 of the carriage assembly 28 are substantially L-shaped. The shanks of the forks 30 are pivotally mounted at their proximal ends to the upper fork bar 34 by means of pins 32. A pair of actuators 36 mounted to the upper fork bar 34 provide control of the movement of the forks 30 about the pivot pins 32. More particularly, one actuating cylinder 36 includes an extensible rod 72 attached by means of a pivot pin to a flange 74 on one of the forks 30. Similarly, the other actuator cylinder 36 includes an extensible rod 72 mounted by means of a pivot pin to an inwardly extending flange 74 on the other fork 30. When the rods 72 are extended from the actuators 36, the forks 30 pivot outwardly in the direction of action arrows A (see FIG. 6). Conversely, as the extensible rods 72 are retracted, the forks 30 move in the direction of action arrow B. It should be appreciated that the actuators 36 are independently operable to provide for independent movement of each fork 30 throughout the full range of allowed motion. The operating circuit for the actuators 36 is described in greater detail below in the section entitled "Sideshifter Circuit".

Advantageously, it should be appreciated that the fork pivot points are widely spaced (i.e. approximately 72" apart). This wide stance insures that the shanks of the forks 30 are nearly vertical when carrying most boats. Accordingly, the pivot pins 32 are only loaded vertically in most instances. As a result, angular force moments along the pivot pin axis, that have a tendency to deform the pivot seals and expose the assembly to the corrosive salt water environment, are substantially eliminated. Improved durability results.

As also shown in FIGS. 5 and 6 an inwardly extending strut 76 is mounted to the shank of each fork 30. Each strut 76 includes a rearwardly directed surface for bearing against the lower fork bar 68. Preferably, the bearing surface is formed from a durable low-friction material such as nylon.

As should be appreciated from reviewing the drawing figure, each strut 76 is designed so as to engage and bear against the lower fork bar 68 in all possible positions of the forks 30. This engagement insures that the forks 30 are rigidly supported and also enhances durability by substantially preventing the application of right angle forces axially along the pivot pins 32 when the forks are under load. Advantageously, the strut arrangement also allows capacity loads to be lifted even when the forks 30 are fully expanded. Consequently, the carriage assembly 28 can function as if it were nearly twelve feet wide and effectively support wide beam boats with utmost stability.

As should be appreciated from viewing FIG. 9 showing the forks 30 in section, the horizontally extending leg of each fork 30 which supports the load includes a box beam foundation 78 and a curved upper surface support member 80. The curved support member 80 eliminates knife edge corner loading and provides a large contact surface with a boat hull. This serves to advantageously spread the load across a larger surface area of the hull so as to significantly reduce stress concentrations that could otherwise crack a fiberglass hull in larger, heavier boats. Preferably, both the box beam foundation 78 and upper surface support member 80 are formed from steel for sufficient strength. The box beams 78 and support member 80 are also sealed to prevent water entrance when submerged when, for example, being positioned below a boat to be raised from the water.

The forks 30 are also gradually tapered from the heel, adjacent the shank, to the toe. Preferably each fork has a ten foot bottom taper to approximately a four inch thickness at the toe. This taper makes it easier for the operator to remove boats from trailers and guide the forks 30 between a boat hull and a rack without damaging the rack. Further, this is accomplished without sacrificing the strength and stiffness needed at the heel to support large boats 30 to 35 feet in length.

The forks 30 are covered with a durable non-marking rubber jacket 82 that fits snugly and may be easily replaced. Preferably, the rubber jacket 82 is reinforced with polyester cord to provide a longer service life. The jacket 82 is slipped over the toe of a fork 30 and secured in position at the heel by means of a band clamp 84. Advantageously, the jacket material and the snug fit insure that a minimum amount of water is retained in the jacket 82. Accordingly, dripping that causes stains on underlying craft when positioning a boat in an upper berth of a rack is substantially reduced.

Further, since the jacket 82 covers the entire periphery of the fork 30 on which it is received, the steel fork is protected from direct engagement not only with the boat hull but also the rack in which a boat is being placed. Accordingly, rack damage is minimized including the chipping and scraping of paint from the rack. This is significant as salt water dripping from overlying boats can quickly corrode the exposed steel surface of a rack. Rust from the rack may then drip onto underlying boats staining the finish and furnishings. Advantageously, the present fork design significantly reduces this problem.

Periodically it is desirable to rotate the jackets 82 relative to the forks 30 to extend their service life. This may be achieved by simply loosening the associated band clamps 84 and utilizing the apparatus 10 to lift and place several boats B. As this is done, the engagement of the boats B with the forks 30 serves to rotate the jackets 82 and bring a new portion of the jackets into engagement with the hull of the boat B. Once the jackets 82 are rotated approximately 90 degrees, the band clamps 84 may be retightened to hold the jackets in their new position. In order to protect the jackets 82 from damage through engagement with the ground, a skid plate 86 of heavy steel is mounted beneath the heels of the forks 30.

Operation of the upright and carriage assembly of the apparatus 10 of the present invention will now be described in detail.

Drive Assembly

As briefly mentioned above, the drive assembly of the present invention allows the operator to control the positioning of the movable mast sections 18, 20 and the carriage assembly 28 through manipulation of a single control lever 160 (see FIGS. 3 and 3A). More particularly, the drive assembly operatively connects the mast sections 16, 18, 20 of the upright assembly 12 and the carriage assembly 28 together. The twinned telescoping actuating cylinders 58 operatively connect the outer and intermediate mast sections 16, 18. One end of each of the twinned cylinder 58 is mounted in a bracket on the cross bar 48 of the outer mast section 16 with the opposite end mounted in another bracket on the upper tie bar 50 of the intermediate mast section 18. A first flexible member or dead chain 88 operatively connects the stationary mast section 16 with the inner mast section 20. As shown, one dead chain 88 is provided adjacent each side of the upright assembly 12. Each of the dead chains 88 has one end anchored to the lower U-shaped tie 46 of the outer mast section 16 and the other end anchored to a bracket on the intermediate mast section 18. Each of the chains 88 is also played over a sheave 90 mounted adjacent the top of the intermediate mast section 18.

A lift linkage including a second flexible member or dead chain 92 operatively connects the intermediate mast section 18 and the carriage assembly 28. Again, one dead chain 92 is provided adjacent each side of the upright assembly 12. Each dead chain 92 has one end anchored to a bracket 93 on the carriage assembly 28. Further, each dead chain 92 is played over a sheave 94 mounted adjacent the top of the inner mast section 20.

When the upright assembly 12 and carriage assembly 28 are moved from the ground level position to the fully raised position the actuating cylinders 58 are extended. This directly results in the raising of the intermediate mast section 18 relative to the outer mast section 16. With the raising of the intermediate mast section 18, the length of the first dead chains 88 played out over the sheaves 90 is gradually shortened. This causes the inner mast section 20 to be extended and moved upwardly relative to the intermediate mast section 18. The relative movement of the inner mast section 20 in turn causes the length of the dead chains 92 played out over the sheaves 94 to be gradually shortened. Since the stop nuts 100 are in abutting engagement and capture the guide sleeves 98 at the ground level position and above, the dead chains 92 are now engaged. As a result, the carriage assembly 28 is moved upward relative to the inner mast section 20 until it is fully extended in its uppermost position as shown in FIG. 6.

Whether raising or lowering an article with the apparatus 10, a single operator control 160 is all that needs to be manipulated. Additionally, it should be appreciated that the drive assembly between the upright assembly 12 and carriage assembly 28 is effectively designed so that at ground level, the carriage assembly 28 is always in its lowermost position on the inner mast section 20. Thus, as soon as the carriage assembly 28 and particularly the forks 30 clear ground level, the operator is assured that each of the mast assemblies 18, 20 has also cleared ground level. Accordingly, the operator can quickly and easily confirm when the necessary clearance is present to allow him to back away from the dock D.

In prior art designs where separate controls and cylinder and chain sets are required for extension and retraction of the mast assemblies and raising and lowering of the carriage assembly, this is not necessarily true. For example, depending on the particular manipulation of the controls, the situation can arise where the carriage assembly and the boat maintained on the forks is above ground level while one or more of the mast sections is still extended below ground level. Under these circumstances, any attempt to back away from the dock D meets with the engagement of the downwardly extended mast section into the front edge of the dock D. Such an impact could damage the dock D or mast section. Advantageously, this potential problem is avoided with the apparatus 10 of the present invention.

Sideshifter Circuit

Figure 7:
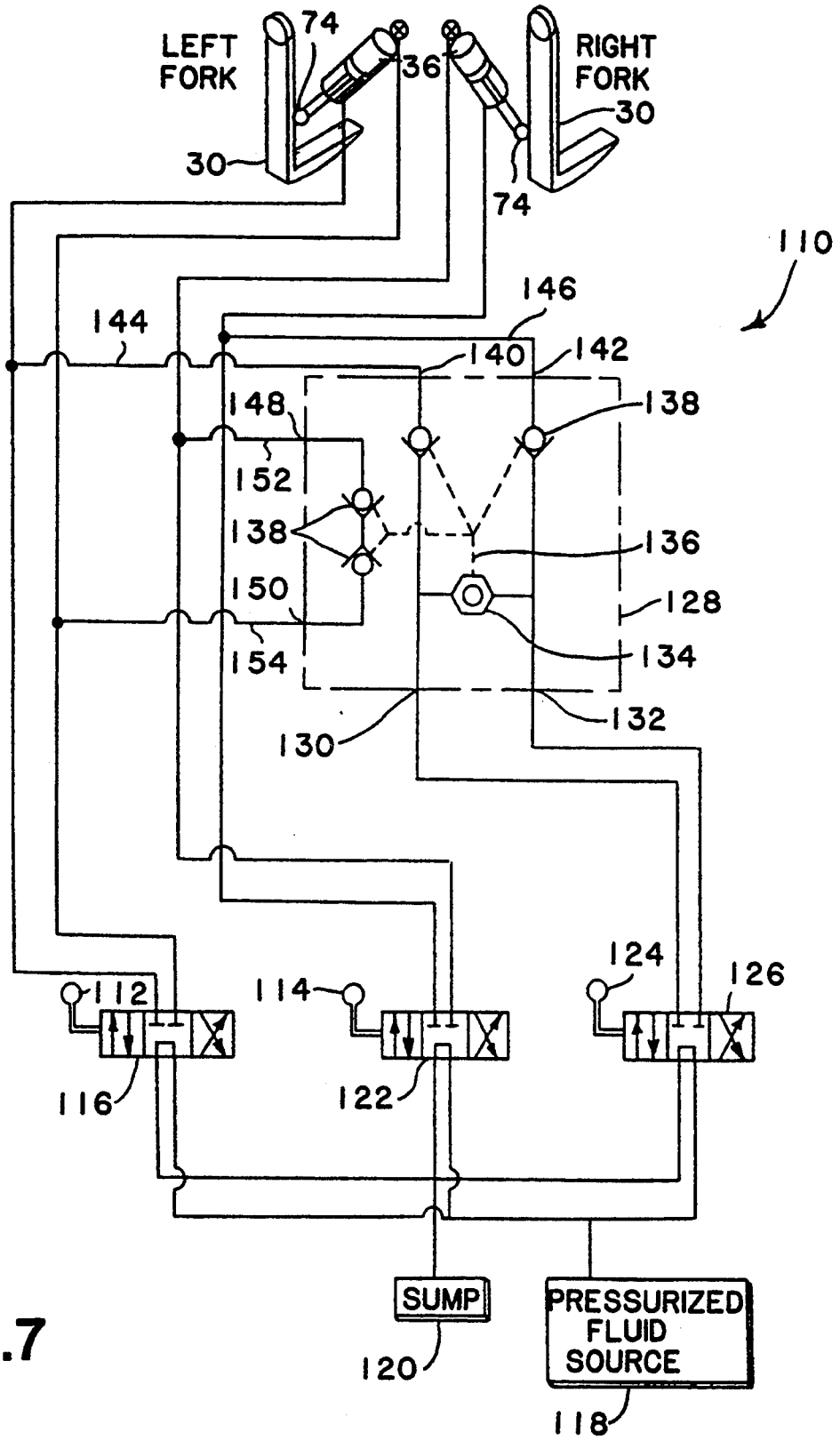
FIG. 7 is a schematical circuit diagram showing the sideshifter circuit for shifting the forks of the lift assembly of the present invention.

In accordance with an additional aspect of the present invention, the apparatus 10 may incorporate a unique sideshifter circuit 110, shown schematically in FIG. 7. More specifically, when using a lift truck to handle a variety of loads with differing shapes and sizes such as boats in a marina, it is desirable to be able to move each fork independently. This allows the operator to better position each of the forks around and under the boat. It is also desireable to be able to sideshift the boat while elevated in order to make minor lateral adjustments as the boat is set into place or to center the boat relative to the truck before transport.

As indicated above, the forks 30 are pivotally mounted to the carriage assembly 28 by means of the pivot pins 32 received in the upper fork bar 34. A pair of actuator cylinders 36 having a base end mounted to the upper fork bar 34 and a rod end attached by means of brackets 74 to the forks 30 control the positioning of the forks.

The left and right forks 30 may be independently positioned by manipulation of the control levers 112, 114 respectively. As shown, the control lever 112 is operatively connected to a directional control valve 116 that controls flow between a pressurized fluid source 118, the actuator 36 controlling the left fork 30 and a sump 120. Similarly, the control lever 114 is directly connected to a directional control valve 122. This control valve 122 controls flow between the pressurized fluid source 118 the actuator 36 connected to the right fork 30 and the sump 120. By manipulating the control levers 112 and 114 and hence the directional control valves 116 and 122, the rods of the actuators 36 may be independently and selectively retracted and extended to narrow or widen the spacing between the forks 30.

In prior art lift truck designs, it is only possible to sideshift the forks utilizing the two control levers that independently control the left and right forks; that is control levers equivalent to the levers 112 and 114 described above. Convention dictates that when the two control levers are actuated in the same or apart; the forks move together or apart depending on the direction of lever movement. Accordingly, when an operator wants to sideshift a load, he must use two hands to move the control levers equal distances in the direction he wishes to shift the load. In order to keep the load from rocking, a great deal of training and skill is necessary to feather the levers as needed and maintain the load in position on the forks while laterally shifting the load the desired distance. Further, when one of the forks reaches its limit of travel, the operator must be careful and stop further movement of the other fork. This is because continued movement of the fork would cause it to begin to slide under the load. When this occurs, the load may become unstable. Advantageously, these problems are avoided utilizing the sideshifter circuit of the present invention.

More particularly, a separate lever 124 operatively connected to a directional control valve 126 is provided for sideshifting the load. As shown, the directional control valve 126 controls the flow of pressurized fluid between the pressurized fluid source 118, the two actuators 36 and the sump 120.

More particularly, the sideshifter circuit includes a valve housing 128. The housing 128 includes a pair of control valve ports 130, 132 connecting the valve housing 128 to the directional control valve 126. A shuttle check valve 134 is connected across the ports 130, 132. A pilot fluid feed line 136 leads from the shuttle check valve 134 to four piloted check valves 138.

The valve housing 128 also includes a pair of actuator ports 140, 142 connected to feed lines 144, 146, respectively, that provide communication with the rod ends of the actuators 36. More particularly, the port 140 is in communication with the rod end of the left fork actuator 36 while the port 142 is in fluid communication with the rod end of the right fork actuator 36.

Additionally, the valve body 128 includes two diverter ports 148, 150. The diverter ports 148, 150 are connected to feed lines, 152, 154 respectively, that provide fluid communication between the diverter ports and the base ends of the actuators 36. More particularly, the diverter port 148 is in fluid communication with the base end of the right fork actuator 36 while the diverter port 150 is in fluid communication with the base end of the left fork actuator 36.

One of the pilot operated check valves 138 controls flow through each of the actuator ports 140, 142 and diverter ports 148, 150. The check valves 138 prevent flow through the actuator ports 140, 142 and diverter ports 148, 150 unless piloted open by hydraulic pressure through the line 136 from the shuttle check valve 134.

When the sideshift control lever 124 is moved in a first direction to position the forks 30 to the right, the directional control valve 126 directs fluid from the pressurized fluid source 118 to the port 130. The fluid flows from the port 130 through the valve housing 128 and out the port 140 where it is directed to the rod end of the left fork actuator 36. Flow is blocked in the opposite direction by the left fork directional control valve 116 which is in the neutral position.

Pressure developed in the port 130 is made available to the shuttle check valve 134. Valve 134 makes the pressure available through feed line 136 to pilot all four piloted check valves 138 open. As a result, fluid returning from the base end of the left fork actuator 36 is allowed to flow into the valve body 128 through the diverter port 150. The other potential flow path is blocked by the left fork directional control valve 116. The flow entering the port 150 is directed through the valve body 128 and the diverter port 148 to the base end of the right fork actuator 36. Fluid flow in the other direction is blocked by the right fork directional control valve 122. Due to the operation of the diverter ports 148, 150 of the valve body 128, return flow from the left fork actuator 36 has become the supply flow for the right fork actuator 36. Since the actuators 36 have equal areas both the left and right actuators are now operated at equal velocities. Further, since the forks 30 are of equal geometry, the forks 30 move together in the same direction at substantially the same speed in a coordinated fashion. Accordingly, load rocking is minimized.

Flow returning from the rod end of the right actuator 36 is blocked by the right fork directional control valve 122 and thereby enters the valve body at the port 142. The flow then passes through the valve body 128 and out the port 132 with fluid returning through the directional control valve 126 to the sump 120.

Similarly, when the sideshift control lever 124 is moved in the opposite direction to position the forks to the left, the sideshift directional control valve 126 directs fluid to the port 132. The fluid flows through the valve body 128 and the port 142 to the rod end of the right fork actuator 36. Pressure developed in the port 132 is made available to the shuttle check valve 134 which then directs that pressure through the pilot feed line 136 to the pilot operated check valves 138 which consequently open. Fluid returning from the base end of the right fork actuator 36 then enters the diverter port 148 and is directed through the valve body 128 and the diverter port 150 to the base end of the left fork actuator 36. Hence, return flow from the right fork actuator 36 becomes the supply flow for the left fork actuator 36. Accordingly, the forks 30 are moved in a coordinated fashion in the same direction at substantially the same speed. Flow returning from the rod end of the left fork actuator 36 enters the port 140 and passes through the valve body 128 and the port 130. From there the fluid is directed through the directional control valve 126 to the sump 120.

Advantageously, it should be appreciated that if either fork actuator 36 reaches its limit of travel, fluid flow through both actuators stops. Accordingly, the forks 30 maintain their spacing under the boat B. Thus, the possibility of sliding a fork under the boat in these circumstances is eliminated. Consequently, the stability of the boat B on the forks The carriage assembly 28 includes pivotally mounted forks 30 with relatively widely spaced pivot points. The forks 30 also include an inside strut arrangement that cooperates with the wide pivot points to significantly enhance the durability of the design; and give it the ability to cradle large boats having a beam significantly wider than the spacing between the pivots for the forks, 30, on the fork bar, 34. Referring to FIG. 6, the dashed line position of the forks, 30, illustrates the movement of the forks from the vertical position in the direction of arrows, A, to the widest spacing for accommodating large boats. Conversely, the position of the forks, 30, as shown by the dot-dash-line depicts the movement of the forks from the vertical position in the direction of arrows, F, to the narrowest spacing as would be required for handling smaller boats. The struts, 76, travel with the forks, 30, in a sliding bearing relationship against the surface of bar, 68, which remains stationary in supporting the reaction of forces of the load.

The forks 30 also have a unique composite construction. More specifically the forks include a curved upper surface member 80 that reduces stress concentrations and spreads the load over a larger area of the boat being handled. Additionally, a rubber jacket 82 specially contoured to fit the forks 30 serves to cushion the boat on the forks and prevent the underlying metal structure of the forks from directly contacting both the boat and the rack or trailer upon which the boat may be placed or from which it may be removed.

A unique hydraulic sideshifter circuit 110 is also provided. The circuit is of a relatively simple design and advantageously is fully responsive to a single operator control 124. The circuit 110 serves to fully coordinate the movement of the forks 30 to the right or left as desired when placing or picking up a boat. The circuit also serves to prevent any possibility of passing a fork under the boat when laterally shifting the boat by stopping the movement of both forks when one of the forks 30 reaches its limit of travel.

The foregoing description of the preferred embodiment of the invention has been presented for purposes of illustration and description. It is not intended to be exhaustive or to limit the invention to the precise form disclosed. Obvious modifications or variations are possible in light of the above teachings. The preferred embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

We claim:

1. An upright assembly for a counterbalanced lift truck having a front chassis portion adapted for carrying said upright assembly and a rear chassis portion adapted for carrying a counterweight for counterbalancing a load to be lifted on said upright assembly comprising;

pivotal mounting means on the upright assembly cooperating with said front chassis portion of the truck to allow the upright assembly to tilt forward or backward from a vertical plane;

cylinder means extending between the lift truck and upright assembly for tilting it on said pivotal mounting means;

a pair of forks spaced laterally apart adapted for movement up and down on the upright assembly in raising or lowering a load, each fork having a horizontal load carrying portion and a vertical leg portion secured to the horizontal load carrying portion;

fork mounting means supported on the upright assembly for movement thereon, each fork being suspended thereon from said vertical leg portion and pivoting on an axis substantially parallel to, and vertically above, said horizontal load carrying portion in a primary load engagement position of said pair of forks;

cylinder means connected to said fork mounting means for moving it up and down the upright assembly;

fork actuator means on the fork assembly means causing one or both of said forks to pivot on its axis to one side or the other on each fork outwardly from its primary load engagement position;

strut means cooperating between each said vertical leg portion and fork mounting means along a path extending laterally wider than the primary load engagement position establishing a bearing surface extending outwardly therefrom for lifting loads wider than fork spacing in the primary load engagement position.

2. An upright assembly as set forth in claim 1 wherein said strut means includes a curved structural member secured to each vertical leg portion projecting laterally inwardly to provide and arcuate path for said bearing surface.

3. An upright assembly as set forth in claim 1 wherein said fork actuator means comprising a pair of cylinders, one connected to open fork intermediate the horizontal load carrying portion and the pivot axis and the other similarly connected to the other fork, said cylinders being extended or retracted separately or in unison for pivoting said forks; and fluid circuit means for controlling said cylinders.

4. An upright assembly as set forth in claim 3 wherein said fluid circuit means comprises;

valve means for controlling said cylinder such that the forks are moved at a same rate of travel.

5. An upright assembly as set forth in claim 4 wherein the fluid circuit means includes a source of fluid pressure;

operator control means on the lift truck, first valve means actuated by the operator control means for causing said forks to pivot laterally together to one side or the other of said primary load engagement position of the forks; and second valve means actuated by said operator control means causing each fork to pivot laterally toward or away from the other from said position.

6. An upright assembly for a lift truck having drive and steerable wheels on which the lift truck and upright assembly travel in lifting, maneuvering and transporting loads comprising;

a carriage assembly supported for a movement up and down said upright assembly in a direction upwardly above the wheels in a positive lift mode and in a direction below the wheels in a negative lift mode;

a pair of forks, spaced apart on the carriage assembly approximately the width of the upright assembly, each fork having a horizontal blade portion for engaging a load to be lifted and a vertical rear leg portion secured to the blade portion;

said carriage assembly including upper and lower horizontal fork bars extending substantially the width of said upright assembly behind said rear leg portions of the forks;

pivotal mounting means on the upper fork bar to which said rear leg portions are mounted from which the forks are pivoted;

actuator means mounted on said carriage assembly connected to each fork for pivoting both forks in one direction, or each fork toward or away from the other; and bearing means connected to each fork projecting laterally in overlapping relationship with said lower fork bar for maintaining engagement therewith when either of said forks is pivoted wider than the upright assembly to accommodate oversized loads whereby the carriage assembly may be lowered from in the negative lift mode with the forks spread wider than the upright assembly and thereafter the forks are pivoted inwardly for engaging the load from above.

7. An upright assembly as set forth in claim 6 wherein the bearing means comprises a pair of strut numbers, each connected to a vertical leg portion of a fork and extending arcuately inwardly in the overlapping relationship with said lower fork bar establishing a sliding bearing engagement therewith and serving as extension of said lower fork bar in absorbing load lifting forces when the forks are pivoted laterally outwardly of the upright assembly.

8. An upright assembly as set forth in claim 7 wherein the loads to be lifted are primarily watercraft having a hull the longest dimension of which is aligned with the truck, and the portion exposed above the waterline is primarily of a width greater than the width of the upright assembly and said forks are capable of being pivoted outwardly to a width to allow them to be lowered adjacent the waterline in the negative lift mode before being pivoted inwardly toward the hull in load lifting engagement therewith whereby the load is engaged without having to move the truck.

9. An upright assembly as set forth in claim 8 wherein the blade portions of the forks along inner lengths thereof have curved surfaces making arcuate engagement with opposite sides of the hull for minimizing marking thereon.

10. An upright assembly as set forth in claim 9 including means for stopping said forks at a predetermined limit of travel.

11. An upright assembly as set forth in claim 9 including hydraulic circuit means for operating said actuator means in pivoting said forks.

* * * * *